US007418951B2

(12) United States Patent
Hazama

(10) Patent No.: US 7,418,951 B2
(45) Date of Patent: Sep. 2, 2008

(54) FUEL FEED APPARATUS HAVING CONTROL UNIT FOR FUEL PUMP

(75) Inventor: Tadashi Hazama, Chita-gun (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/713,595

(22) Filed: Mar. 5, 2007

(65) Prior Publication Data

US 2007/0215115 A1 Sep. 20, 2007

(30) Foreign Application Priority Data

Mar. 3, 2006 (JP) ..... 2006-057751

(51) Int. Cl.
*F02M 37/04* (2006.01)
*F02M 37/08* (2006.01)

(52) U.S. Cl. ..... 123/509; 123/494

(58) Field of Classification Search ..... 123/509, 123/495, 497, 458, 480, 457, 494
See application file for complete search history.

(56) References Cited

U.S. PATENT DOCUMENTS

| | | | | |
|---|---|---|---|---|
| 5,483,940 | A * | 1/1996 | Namba et al. | 123/497 |
| 6,382,184 | B2 * | 5/2002 | Nakamura et al. | 123/464 |
| 6,450,148 | B2 * | 9/2002 | Nakamura et al. | 123/464 |
| 6,453,878 | B1 * | 9/2002 | Mazet | 123/497 |
| 6,776,141 | B2 * | 8/2004 | Hamada et al. | 123/458 |
| 7,124,740 | B2 * | 10/2006 | Nomura et al. | 123/458 |
| 2004/0139946 | A1 * | 7/2004 | Hamada et al. | 123/458 |
| 2004/0206337 | A1 * | 10/2004 | Tokuyasu et al. | 123/497 |
| 2005/0229906 | A1 * | 10/2005 | Hosoya | 123/457 |
| 2006/0081219 | A1 * | 4/2006 | Nomura et al. | 123/458 |

FOREIGN PATENT DOCUMENTS

| | | |
|---|---|---|
| JP | 07-293397 | 11/1995 |
| JP | 2001-099028 | 4/2001 |
| JP | 2001-214826 | 8/2001 |
| JP | 2001-214827 | 8/2001 |

* cited by examiner

*Primary Examiner*—Mahmoud Gimie
(74) *Attorney, Agent, or Firm*—Nixon & Vanderhye PC

(57) ABSTRACT

A fuel feed apparatus is provided for supplying fuel from a fuel tank to an internal combustion engine, which is controlled using an engine control unit. The fuel feed apparatus includes a pump module that is provided to the fuel tank. The pump module includes a fuel pump that is accommodated in the fuel tank for pumping fuel from the fuel tank. The fuel feed apparatus further includes a pressure detecting unit that is provided in a downstream of the fuel pump for detecting pressure of fuel. The fuel feed apparatus further includes a pump control unit that is provided separately from the engine control unit for controlling a driving signal of the fuel pump in accordance with a detection signal of the pressure detecting unit.

7 Claims, 4 Drawing Sheets

FUEL FEED APPARATUS HAVING CONTROL UNIT FOR FUEL PUMP

CROSS REFERENCE TO RELATED APPLICATIONS

This application is based on and incorporates herein by reference Japanese Patent Application No. 2006-57751 filed on Mar. 3, 2006.

FIELD OF THE INVENTION

The present invention relates to a fuel feed apparatus that includes a control unit for a fuel pump.

BACKGROUND OF THE INVENTION

Conventionally, a fuel feed apparatus has a fuel pump accommodated in a fuel tank. The fuel pump is applied with constant voltage to pump fuel to an internal combustion engine. The engine returns surplus fuel, which is not consumed in the engine, into the fuel tank through a pressure regulator provided in the vicinity of the engine. Alternatively, a fuel feed apparatus has a pressure regulator for controlling pressure of fuel discharged from a fuel pump, thereby supplying the pressure-controlled fuel by an amount consumed in the engine.

In such a fuel feed apparatus, the fuel pump regularly discharges the maximum amount of fuel equivalent to the capacity of the engine, and surplus fuel, which is not consumed by the engine, is exhausted from either the engine or the fuel feed apparatus. Consequently, the fuel pump consumes a large amount of energy. Furthermore, the surplus fuel is exhausted into the fuel tank, consequently, a large amount of fuel vapor is produced in the fuel tank produces.

A fuel feed apparatus, disclosed in JP-A-7-293397, includes a fuel pump for supplying fuel from a reservoir tank into each of injection valves provided respectively to cylinders. A pressure sensor is provided for detecting pressure of the fuel supplied from the reservoir tank. The fuel feed apparatus controls the fuel pump in accordance with an operation of the engine so as to maintain pressure of fuel in the reservoir tank at predetermined pressure. Such a fuel feed apparatus has a return-less structure, in which production of surplus fuel is suppressed by controlling an amount of fuel to correspond with the capacity of the engine.

In this fuel feed apparatus of JP-A-7-293397, one engine control unit (ECU) controls the fuel injection valve to control the operation of the engine, in addition to controlling the fuel pump. Consequently, the engine control unit is operated under heavy load.

By contrast, each of JP-A-2001-214826, JP-A-2001-214827 discloses a pump control unit (fuel pump controller: FPC). The FPC is provided separately from the engine control unit, thereby reducing load imposed on the engine control unit.

However, in each of the fuel feed apparatuses of JP-A-2001-214826, JP-A-2001-214827, the FPC controls the fuel pump in accordance with both the pressure of fuel discharged from the fuel pump and information, which indicates the operating condition of the engine, transmitted from the engine control unit. Accordingly, the FPC cannot control the fuel pump without the information transmitted from the engine control unit.

SUMMARY OF THE INVENTION

The present invention addresses the above disadvantage.

According to one aspect of the present invention, a fuel feed apparatus is provided for supplying fuel from a fuel tank to an internal combustion engine controlled using an engine control unit. The fuel feed apparatus includes a pump module that is provided to the fuel tank. The pump module includes a fuel pump that is accommodated in the fuel tank for pumping fuel from the fuel tank. The fuel feed apparatus further includes a pressure detecting unit that is provided in a downstream of the fuel pump for detecting pressure of fuel. The fuel feed apparatus further includes a pump control unit that is provided separately from the engine control unit for controlling a driving signal of the fuel pump in accordance with a detection signal of the pressure detecting unit.

According to another aspect of the present invention, a method, which is for controlling a fuel pump for an internal combustion engine controlled using an engine control unit, includes evaluating whether the engine control unit transmits an instruction. The method further includes setting a target pressure in accordance with the instruction, when the engine control unit transmits the instruction. The method further includes setting the target pressure at a predetermined pressure, when the engine control unit does not transmit the instruction. The method further includes detecting actual pressure of fuel supplied from the fuel pump. The method further includes manipulating discharge pressure of the fuel pump by operating a driving signal for the fuel pump in accordance with a comparison between the target pressure and the actual pressure.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
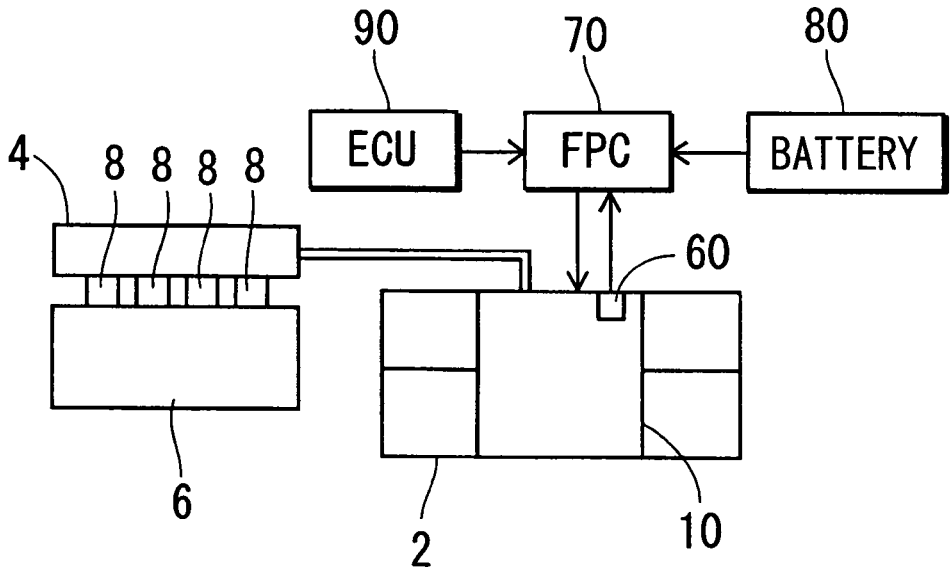
FIG. 1 is a schematic view showing a fuel feed apparatus provided to an internal combustion engine, according to a first embodiment.
Figure 2:
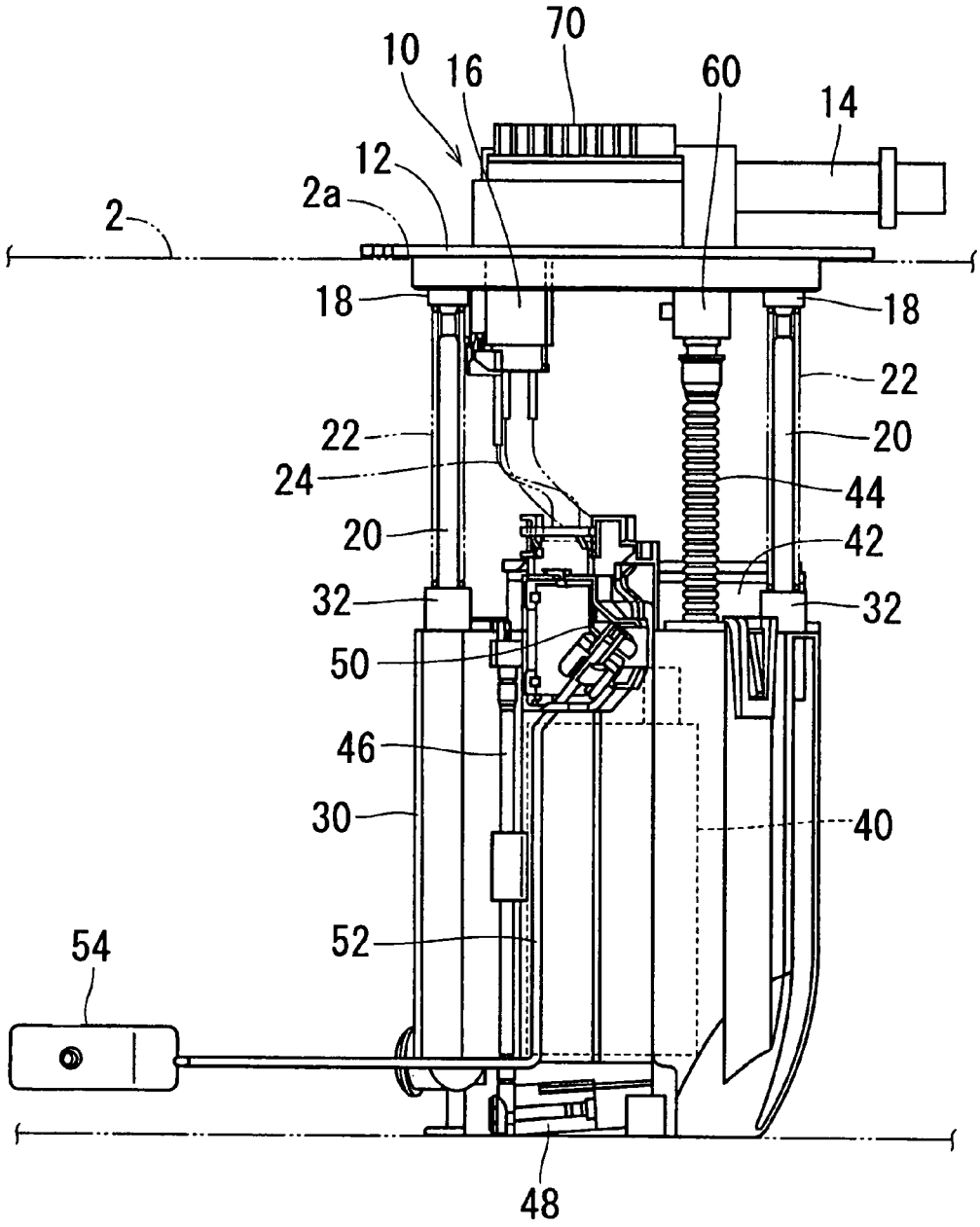
FIG. 2 is a sectional view showing the fuel feed apparatus mounted to a fuel tank.

As shown in FIGS. 1, 2, a fuel feed apparatus includes a pump module 10, a pump control unit (fuel pump controller: FPC) 70, and the like. The pump module 10 is provided to a fuel tank 2 for pumping fuel from the fuel tank 2 into a delivery pipe 4. A pressure sensor 60 is provided to the pump module 10 for detecting pressure of fuel supplied from the pump module 10 into the delivery pipe 4. The pressure sensor 60 serves as a pressure detecting unit. The delivery pipe 4 is provided with fuel injection valves 8. Each of the fuel injection valves 8 is provided to each cylinder of an internal combustion engine 6.

The FPC 70 is supplied with electric power from a battery 80. The FPC 70 controls electricity for driving a fuel pump 40 (FIG. 2) of the pump module 10, thereby controlling pressure of fuel discharged from the fuel pump 40. The FPC 70 manipulates a diving signal for the fuel pump 40 so as to control pressure of fuel discharged from the fuel pump 40, in accordance with both an instruction signal transmitted from an engine control unit (ECU) 90 and the detection signal of the pressure sensor 60 for detecting pressure of fuel. Thus, the FPC 70 controls the pressure of fuel in accordance with the operating condition of the engine 6. The ECU 90 inputs signals, which indicates the operating condition of the engine 6, from various sensors (not shown), thereby controlling an amount of fuel injected using the fuel injection valve 8 and the like, in accordance with the operating condition of the engine 6.

Next, the fuel feed apparatus is described in detail.

As shown in FIG. 2, in this embodiment, the pressure sensor 60 and the FPC 70 are provided to the pump module 10. The fuel feed apparatus is constructed of an integrated module including the pump module 10, the pressure sensor 60, and the FPC 70.

The pump module 10 includes a flange 12, a sub-tank 30, the fuel pump 40, a fuel filter 42, a jet pump 48, a suction filter (not shown), and the like. The flange 12 serves as a lid member. The pump module 10 is an in-tank pump module. Components of the pump module 10 excluding the flange 12 are accommodated in the fuel tank 2.

The flange 12 is in a substantially disc-shape. The flange 12 plugs an opening 2*a* formed in an upper wall of the fuel tank 2. The flange 12 is provided with a fuel outlet pipe 14, an electric connector 16, and the FPC 70. The flange 12 has, for example, two press-insert portions 18 on the side of the sub-tank 30. Each of two shafts 20 has one end that is press-inserted into each of the two press-insert portions 18.

Each of the shafts 20 has the other end that is loosely inserted into each support 32 provided to the outer circumferential periphery of the sub-tank 30. Each spring 22 is attached to the outer periphery of each shaft 20, thereby biasing the flange 12 to separate from the sub-tank 30. In this structure, the spring 22 applies force to the sub-tank 30 to urge the sub-tank 30 onto the inner wall of the bottom of the fuel tank 2 in a condition where the pump module 10 is provided to the fuel tank 2.

The fuel outlet pipe 14 is connected with a bellows pipe 44. The fuel pump 40 pressurizes fuel, and the fuel filter 42 removes foreign matters from the fuel. The filtered fuel is supplied to the outside of the fuel tank 2 through the fuel outlet pipe 14. The bellows pipe 44 is connected with the fuel outlet pipe 14 via a connecting portion, to which the pressure sensor 60 is provided. The fuel pump 40 pressurizes fuel, and the pressurized fuel is partially supplied into the jet pump 48 through a nylon tube 46. The fuel is supplied into the jet pump 48 through the nylon tube 46, and the jet pump 48 jets the fuel to generate negative pressure, so that the jet pump 48 pumps fuel from the fuel tank 2 into the sub-tank 30. The fuel pump 40 is electrically connected with a level meter (sender gauge) 50 via the electric connector 16 and a lead wire 24.

The level meter 50 is provided to the outer periphery of the sub-tank 30. The level meter 50 includes an arm 52 and a float 54. The arm 52 connects with the float 54, which vertically moves corresponding to the amount of fuel remaining in the fuel tank 2. The level meter 50 detects the amount of fuel remaining in the fuel tank 2 in accordance with the position of the arm 52 connecting with the float 54.

The pressure sensor 60 is provided to the connecting portion between the bellows pipe 44 and the fuel outlet pipe 14. This connecting portion is located on the side of the flange 12 opposed to the interior of the fuel tank 2. Even when fuel leaks through the connecting portion among the fuel outlet pipe 14, the bellows pipe 44, and the pressure sensor 60, the fuel leaking therethrough returns into the fuel tank 2. Therefore, the connecting portion among the fuel outlet pipe 14, the bellows pipe 44, and the pressure sensor 60 need not be strictly sealed, and may have a simple structure. The fuel pump 40 discharges fuel, and supplies the fuel into the delivery pipe 4 (FIG. 1) through the fuel filter 42, the bellows pipe 44, and the fuel outlet pipe 14. The pressure sensor 60 detects pressure of the fuel supplied from the fuel pump 40 into the delivery pipe 4, and outputs the detection signal, which indicates the pressure of the fuel, to the FPC 70. In this structure, the pressure sensor 60 detects the pressure of the fuel in the downstream of the fuel filter 42 with respect to the flow direction of the fuel. Therefore, even when pressure of fuel changes due to clogging in the fuel filter 42, the pressure sensor 60 is capable of accurately detecting pressure of fuel, which flows from the pump module 10 to the delivery pipe 4, in the downstream of the fuel filter 42. In addition, the pressure sensor 60 is provided to the pump module 10, so that the fuel passage between the fuel pump 40 and the pressure sensor 60 can be reduced in length. Thus, pressure drop caused in the fuel passage between the fuel pump 40 and the pressure sensor 60 can be possibly reduced, so that the pressure sensor 60 is capable of accurately detect pressure of fuel discharged from the pump module 10.

Figure 3:
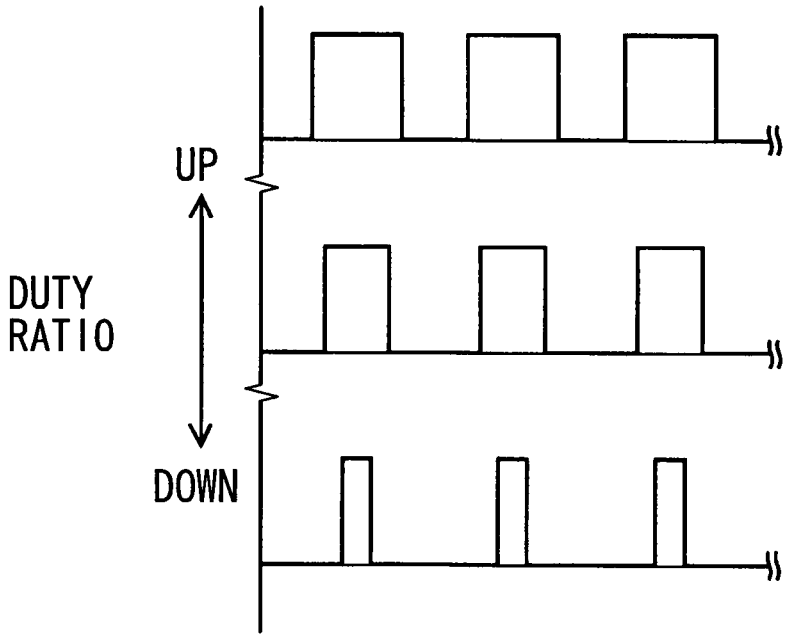
FIG. 3 is a graph showing diving voltage applied to a fuel pump of the fuel feed apparatus.

The FPC 70 is provided to the flange 12 on the side out of the fuel tank 2. The FPC 70 is electrically connected with the pressure sensor 60 and the electric connector 16. The FPC 70 includes a CPU, a ROM, a condenser, a coil, and the like. The CPU of the FPC 70 executes a control program stored in the ROM, thereby controlling the driving signal of the fuel pump 40. The condenser and the coil of the FPC 70 construct a LC circuit (inductance-capacitance circuit) for reducing electric noise generated in the FPC 70. As shown in FIG. 3, the FPC 70 controls the duty ratio of the driving voltage applied to the fuel pump 40, thereby controlling the discharge pressure of the fuel pump 40. As the duty ratio of the driving voltage applied to the fuel pump 40 increases, the discharge pressure of the fuel pump 40 increases. On the contrary, as the duty ratio of the driving voltage decreases, the discharge pressure of the fuel pump 40 decreases.

Figure 4:
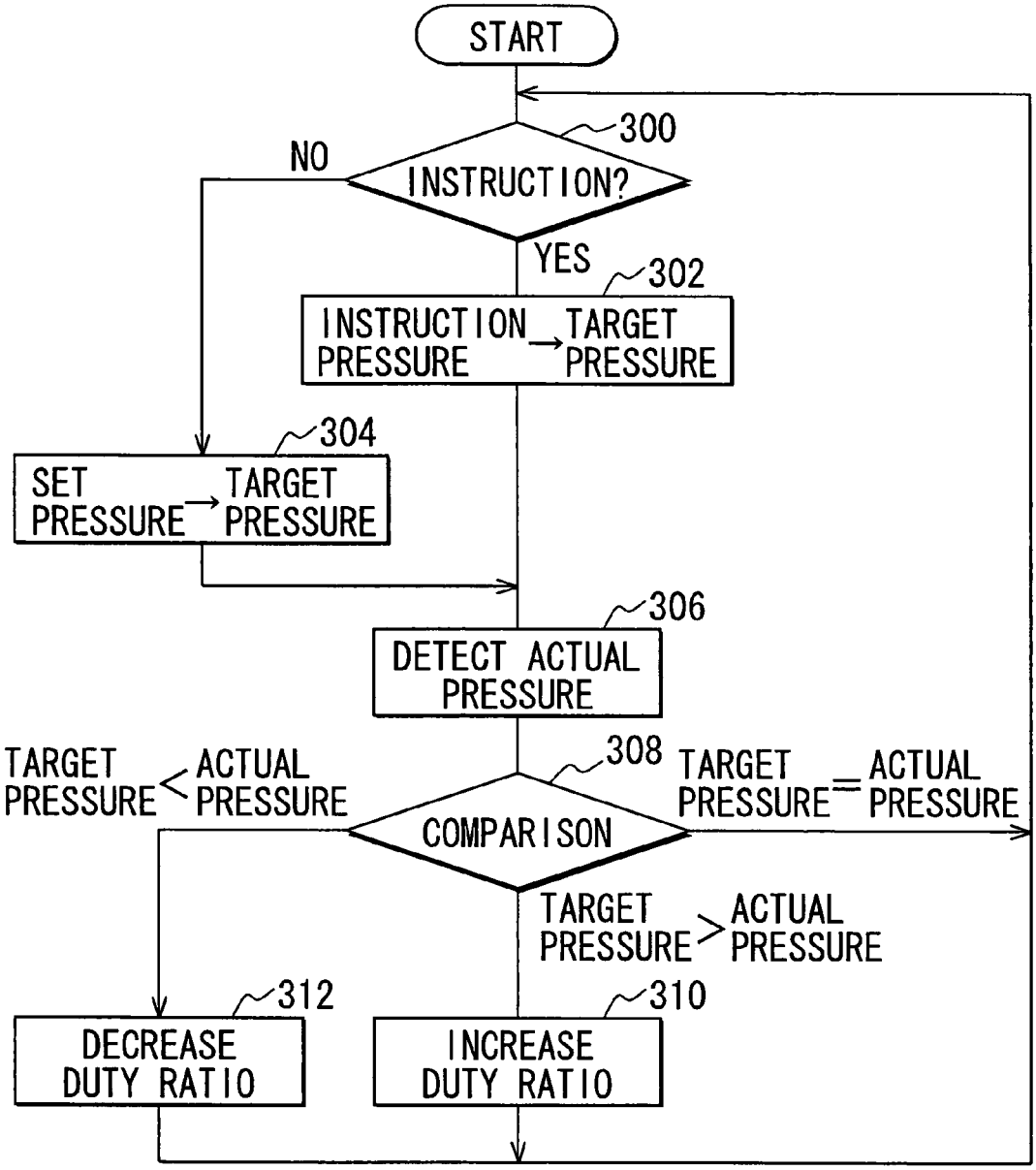
FIG. 4 is a flowchart showing a control of the fuel pump.

Next, a control of the discharge pressure of the fuel pump is described in reference to FIG. 4.

First, in step 300, the FPC 70 evaluates whether the ECU 90 transmits the instruction signal of the target pressure. When the ECU 90 transmits the instruction signal of the target pressure, the routine proceeds to step 302, in which the FPC 70 sets the target pressure at the instruction pressure, which is transmitted from the ECU 90. When the ECU 90 does not transmit the instruction signal in step 300, the routine proceeds to step 304, in which the FPC 70 sets the target pressure at a set pressure, which is beforehand stored in the ROM of the FPC 70. The ECU 90 generates an optimum target pressure in accordance with the operating condition of the engine 6, and transmits the optimum target pressure to the FPC 70.

Second, in step 306, the FPC 70 inputs the detection signal of the pressure sensor 60 to acquire actual pressure of fuel supplied from the pump module 10.

In step 308, the FPC 70 conducts a comparison between the target pressure, which is set in one of steps 302, 304, and the actual pressure. When the target pressure is equal to the actual pressure, the routine proceeds to step 300 without changing the duty ratio of the driving voltage applied to the fuel pump 40.

In step 308, when the target pressure is greater than the actual pressure, the routine proceeds to step 310, in which the FPC 70 increases the duty ratio of the driving voltage so as to increase the discharge pressure of the fuel pump 40, thereafter, the routine returns to step 300.

In step 308, when the target pressure is less than the actual pressure, the routine proceeds to step 312, in which the FPC 70 decreases the duty ratio of the driving voltage so as to decrease the discharge pressure of the fuel pump 40, thereafter, the routine returns to step 300.

In this embodiment, when the ECU 90 does not transmit the instruction of the fuel pressure, the FPC 70 controls the discharge pressure of the fuel pump 40 individually from the ECU 90. Alternatively, when the ECU 90 transmits the instruction of the fuel pressure, the FPC 70 controls the discharge pressure of the fuel pump 40 in accordance with the instruction pressure transmitted from the ECU 90. Therefore, the FPC 70 is capable of variously controlling the pressure of fuel supplied from the pump module 10 in accordance with existence or nonexistence of the instruction pressure from the ECU 90.

The FPC 70 is capable of controlling the fuel pump 40 in accordance with the detection signal of the pressure sensor 60 in the downstream of the fuel pump 40, even when the FPC 70 does not receive information relative to set values of the discharge pressure and a discharge flow amount of the fuel pump 40 from the ECU 90. Thus, the FPC 70 is capable of individually controlling the fuel pump 40.

The FPC 70 is provided to the pump module 10, so that the length of the wiring between the FPC 70 and the pump module 10 can be reduced. Therefore, even when electric noise is caused by the driving signal generated by the FPC 70 in the operation of the fuel pump 40, the electric noise can be reduced by setting the length of the wiring short. In addition, the FPC 70 is provided to the pump module 10, so that the FPC 70 and the pump module 10 can be integrated together to construct the module structure.

Furthermore, the pressure sensor 60 is provided to the pump module 10, so that the pressure sensor 60 and the pump module 10 can be integrated together to construct the module structure.

Second and Third Embodiments

Figure 5:
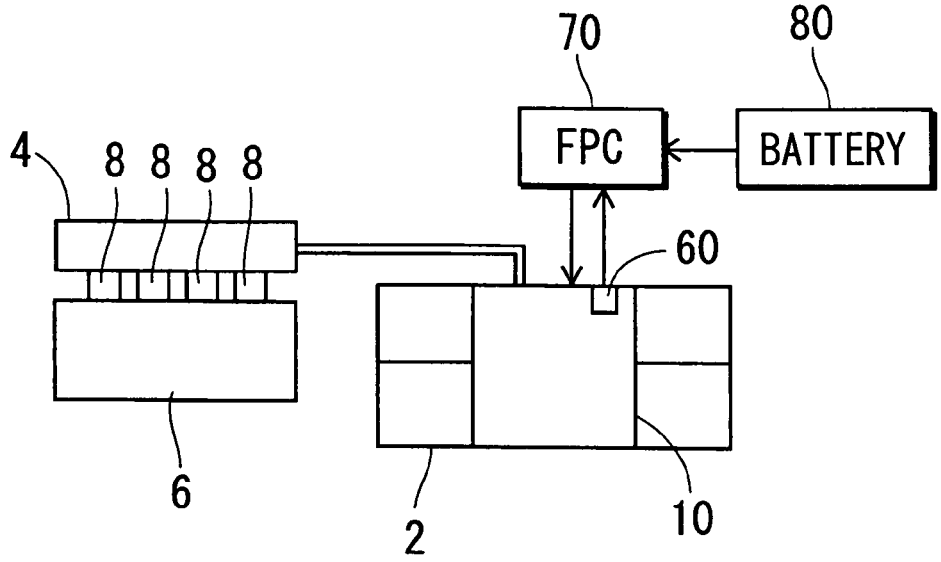
FIG. 5 is a schematic view showing a fuel feed apparatus according to a second embodiment.

As shown in FIG. 5, in the second embodiment, the FPC 70 is separated electrically from the ECU 90, so that the FPC 70 does not receive the instruction of the target pressure from the ECU 90. The FPC 70 controls the discharge pressure of the fuel pump 40 independently from the ECU 90. The FPC 70 may control the discharge pressure of the fuel pump 40 by setting the target pressure at set pressure, which is different from a value in a normal operation, when the engine 6 is in specific operating conditions such as start and stop of the engine 6. When the engine starts, the target pressure is set at a value optimum for starting the engine. Alternatively, when the engine stops, the target pressure is set at optimum residual pressure in the delivery pipe 4, for example.

Figure 6:
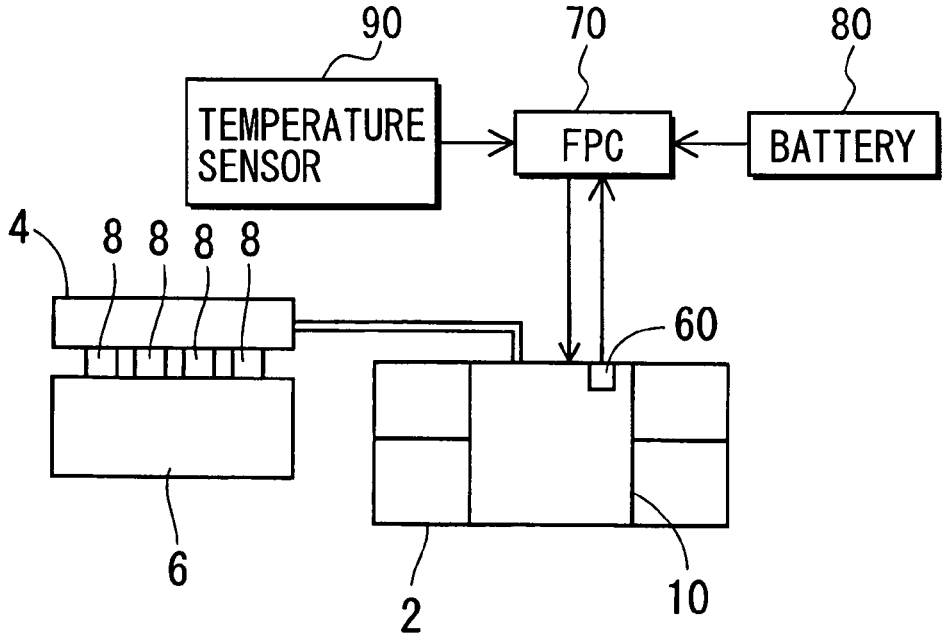
FIG. 6 is a schematic view showing a fuel feed apparatus according to a third embodiment.

As shown in FIG. 6, in the third embodiment, the FPC 70 may input a detection signal, which indicates fuel temperature, from a temperature sensor (temperature detecting unit) 90, in addition to the pressure sensor 60. Thus, the FPC 70 is capable of controlling the discharge pressure of the fuel pump 40 in accordance with the detection signals of both the temperature sensor and the pressure sensor 60. For example, when the fuel temperature is high, fuel is apt to produce vapor therein. In this condition, the FPC 70 is capable of reducing vapor produced in fuel by controlling the discharge pressure of the fuel pump 40 to increase the fuel pressure.

Other Embodiment

In the above embodiments, the pump module 10, the pressure sensor 60, and the FPC 70 are integrated to construct the module structure by providing the pressure sensor 60 and the FPC 70 in the pump module 10. Alternatively, the pressure sensor 60 and the FPC 70 may be provided separately from the pump module 10 such that the pressure sensor 60 and the FPC 70 are distant from the pump module 10.

The above control of the FPC 70 for manipulating the duty ratio of the fuel pump 40 may be, in general, performed for a motor, which has a brush. The motor constructing the fuel pump 40 is not limited to a motor, which has a brush, and may be various motors such as a brushless motor. The FPC 70 may control the driving signal of the fuel pump 40 corresponding to the type of the motor.

In the above embodiments, the FPC 70 controls the discharge pressure of the fuel pump 40 by controlling the duty ratio of the driving voltage applied to the fuel pump 40. Alternatively, the FPC 70 may control the magnitude of the driving voltage to control the discharge pressure of the fuel pump 40. The FPC 70 may manipulate a driving current supplied to the fuel pump 40, instead of manipulating the driving voltage, to control the discharge pressure of the fuel pump 40.

In the above embodiments, the pump module 10 includes the sub-tank 30 that accommodates the fuel pump 40 therein. Alternatively, the pump module may include the fuel pump 40 that is directly accommodated in the fuel tank 2. The fuel filter, which is for removing foreign matters from fuel discharged from the fuel pump 40, may be omitted from the pump module or separately provided from the pump module.

The FPC 70 is not limited to being directly connected with the battery 80. The FPC 70 may be supplied with electricity from another device such as a DC-power device connected with, for example, a battery or an alternator.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. A fuel feed apparatus for supplying fuel from a fuel tank to an internal combustion engine controlled using an engine control unit, the fuel feed apparatus comprising:

a pump module that is provided to the fuel tank, the pump module including a fuel pump that is accommodated in the fuel tank for pumping fuel from the fuel tank;

a pressure detecting unit that is provided in a downstream of the fuel pump for detecting pressure of fuel; and a pump control unit that is provided separately from the engine control unit for controlling a driving signal of the fuel pump in accordance with a detection signal of the pressure detecting unit, wherein the pump control unit and the pressure detecting unit are provided to the pump module, and the pump control unit controls the driving signal without receiving a signal from the engine control unit and independently from the engine control unit.

2. The fuel feed apparatus according to claim 1, wherein the pump module further includes a fuel filter for removing a foreign matter contained in fuel discharged from the fuel pump, and the pressure detecting unit is provided in downstream of the fuel filter.

3. The fuel feed apparatus according to claim 1, further comprising:

a temperature detecting unit for detecting temperature of fuel.

4. The fuel feed apparatus according to claim 1, wherein the pressure detecting unit is a pressure sensor integrated with the pump module, and the pressure sensor is electrically coupled directly with the pump control unit.

5. The fuel feed apparatus according to claim 1, wherein the pump control unit is a separate component from the engine control unit, and the pump control unit is electrically isolated from the engine control unit.

6. The fuel feed apparatus according to claim 1, further comprising:

a battery for supplying electricity to the pump control unit, and wherein the pump control unit is electrically connected directly with the battery.

7. A pump device accommodated in a fuel tank for supplying fuel from the fuel tank to an internal combustion engine controlled using an engine control unit, the pump device comprising:

a fuel pump configured to pump fuel from the fuel tank;

a pressure sensor integrated with the fuel pump for detecting pressure of fuel pumped from the fuel pump; and a pump control unit integrated with the fuel pump for controlling a driving signal of the fuel pump in accordance with a detection signal of the pressure sensor, wherein the pump control unit is a separate component from the engine control unit, and the pump control unit controls the driving signal without receiving a signal from the engine control unit.

* * * * *